US009046804B2

(12) United States Patent
Liu et al.

(10) Patent No.: US 9,046,804 B2
(45) Date of Patent: Jun. 2, 2015

(54) ANGLED ALIGNMENT METHOD FOR LIQUID MATERIALS APPLICATOR IN BETTER CONTACT WITH PHOTORECEPTOR OR BIAS CHARGE ROLLER TO MINIMIZE TORQUE DURING CYCLING

(71) Applicant: XEROX CORPORATION, Norwalk, CT (US)

(72) Inventors: Yu Liu, Mississauga (CA); Sarah J. Vella, Milton (CA); Richard Andrew Klenkler, Oakville (CA); Johann Junginger, Toronto (CA)

(73) Assignee: XEROX CORPORATION, Norwalk, CT (US)

( * ) Notice: Subject to any disclaimer, the term of this patent is extended or adjusted under 35 U.S.C. 154(b) by 85 days.

(21) Appl. No.: 13/922,169

(22) Filed: Jun. 19, 2013

(65) Prior Publication Data

US 2014/0376965 A1 Dec. 25, 2014

(51) Int. Cl.
*G03G 15/02* (2006.01)
*G03G 15/00* (2006.01)

(52) U.S. Cl.
CPC ..... *G03G 15/0233* (2013.01); *G03G 15/75* (2013.01)

(58) Field of Classification Search
CPC ..... G03G 2215/0129; G03G 15/0208; G03G 15/0815; G03G 15/0817; G03G 15/0874; G03G 15/0898; G03G 15/161; G03G 15/1615; G03G 15/2025; G03G 15/5054; G03G 15/757; G03G 21/12; G03G 21/16; G03G 21/18
See application file for complete search history.

(56) References Cited

U.S. PATENT DOCUMENTS

| | | | | |
|---|---|---|---|---|
| 4,387,980 | A | 6/1983 | Ueno | |
| 4,435,074 | A | 3/1984 | Midorikawa | |
| 5,215,839 | A | 6/1993 | Yu | |
| 5,660,961 | A | 8/1997 | Yu | |
| 5,843,567 | A * | 12/1998 | Swift et al. | 428/221 |
| 5,958,638 | A | 9/1999 | Katayama | |
| 6,381,432 | B1 | 4/2002 | Hattori | |
| 7,515,846 | B2 | 4/2009 | Miyaji | |
| 7,580,655 | B2 | 8/2009 | Nukada | |
| 7,725,069 | B2 | 5/2010 | Kawahara | |
| 7,881,651 | B2 | 2/2011 | Watanabe | |

(Continued)

OTHER PUBLICATIONS

U.S. Appl. No. 13/326,414, filed Dec. 15, 2011, McGuire.

(Continued)

*Primary Examiner* — Roy Y Yi
(74) *Attorney, Agent, or Firm* — Pillsbury Winthrop Shaw Pittman LLP

(57) ABSTRACT

An image forming apparatus includes an electrophotographic photoconductive member and a delivery unit. The delivery unit is disposed in contact with a surface of the photoconductive member to apply a layer of functional materials to the surface of the photoconductive member, wherein a cylindrical axis of the delivery unit is angled with respect to a cylindrical axis of the photoconductive member to increase uniformity of the functional materials layer. An image forming apparatus an electrophotographic photoconductive member, a charging unit and a delivery unit disposed in contact with the surface of the charging unit, wherein the delivery unit applies a layer of functional materials to the surface of the photoconductive member. and a cylindrical axis of the delivery unit is angled with respect to a cylindrical axis of the charging unit to increase the uniformity of the functional materials layer.

17 Claims, 7 Drawing Sheets

(56) References Cited

U.S. PATENT DOCUMENTS

| | | | | |
|---|---|---|---|---|
| 8,064,791 | B2 | 11/2011 | Imaizumi | |
| 8,180,256 | B2 | 5/2012 | Komatsu | |
| 2004/0019986 | A1 | 2/2004 | Corrado | |
| 2009/0123187 | A1* | 5/2009 | Teshima | 399/231 |
| 2009/0169237 | A1 | 7/2009 | Shouno | |
| 2010/0189461 | A1 | 7/2010 | Shintani | |
| 2011/0123239 | A1 | 5/2011 | Azeyanagi et al. | |
| 2011/0206430 | A1 | 8/2011 | Arai | |
| 2012/0201585 | A1 | 8/2012 | Hu | |
| 2012/0275836 | A1* | 11/2012 | Kadis et al. | 399/343 |

OTHER PUBLICATIONS

U.S. Appl. No. 13/286,905, filed May 2, 2013, McGuire.
U.S. Appl. No. 13/279,981, filed Apr. 25, 2013, Vella.
U.S. Appl. No. 13/192,252, filed Jan. 31, 2013, Vella.
U.S. Appl. No. 13/192,215, filed Jan. 31, 2013, Hu.

* cited by examiner

ANGLED ALIGNMENT METHOD FOR LIQUID MATERIALS APPLICATOR IN BETTER CONTACT WITH PHOTORECEPTOR OR BIAS CHARGE ROLLER TO MINIMIZE TORQUE DURING CYCLING

BACKGROUND

The present disclosure is generally directed to modifying an angle alignment between a delivery roller and a photoreceptor or bias charge roller. The delivery roller is in contact with a photoreceptor or a bias charge roller and is continuously rotated with the capability to apply a thin layer of oil coating onto the photoreceptor or bias charge roller. The angle between the delivery roller and the photoreceptor and bias charge roller is tuned to minimize the torque between the cleaning blade and photoreceptor.

In electrophotography or electrophotographic printing, the charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image may be developed by contacting it with a finely divided electrostatically attractable powder known as toner. Toner is held on the image areas by the electrostatic charge on the photoreceptor surface. Thus, a toner image is produced in conformity with a light image of the original being reproduced or printed. The toner image may then be transferred to a substrate or support member (e.g., paper) directly or through the use of an intermediate transfer member, and the image affixed thereto to form a permanent record of the image to be reproduced or printed. Subsequent to development, excess toner left on the charge retentive surface is cleaned from the surface. The process is useful for light lens copying from an original image or printing electronically generated or stored originals such as with a raster output scanner (ROS), where a charged surface may be imagewise discharged in a variety of ways.

The described electrophotographic copying process is well known and is commonly used for light lens copying of an original document. Analogous processes also exist in other electrophotographic printing applications such as, for example, digital laser printing and reproduction where charge is deposited on a charge retentive surface in response to electronically generated or stored images. To charge the surface of a photoreceptor, a contact type charging device has been used, such as disclosed in U.S. Pat. No. 4,387,980 and U.S. Pat. No. 7,580,655, which are incorporated herein by reference. The contact type charging device, also termed "bias charge roll" (BCR) includes a conductive member which is supplied a voltage from a power source with a D.C. voltage superimposed with an A.C. voltage of no less than twice the level of the D.C. voltage. The charging device contacts the image bearing member (photoreceptor) surface, which is a member to be charged. The outer surface of the image bearing member is charged at the contact area. The contact type charging device charges the image bearing member to a predetermined potential.

Electrophotographic photoreceptors can be provided in a number of forms. For example, the photoreceptors can be a homogeneous layer of a single material, such as vitreous selenium, or it can be a composite layer containing a photoconductive layer and another material. In addition, the photoreceptor can be layered. Multilayered photoreceptors or imaging members have at least two layers, and may include a substrate, a conductive layer, an optional undercoat layer (sometimes referred to as a "charge blocking layer" or "hole blocking layer"), an optional adhesive layer, a photogenerating layer (sometimes referred to as a "charge generation layer," "charge generating layer," or "charge generator layer"), a charge transport layer, and an optional overcoating layer in either a flexible belt form or a rigid drum configuration. In the multilayer configuration, the active layers of the photoreceptor are the charge generation layer (CGL) and the charge transport layer (CTL). Enhancement of charge transport across these layers provides better photoreceptor performance. Multilayered flexible photoreceptor members may include an anti-curl layer on the backside of the substrate, opposite to the side of the electrically active layers, to render the desired photoreceptor flatness.

Conventional photoreceptors are disclosed in the following patents, a number of which describe the presence of light scattering particles in the undercoat layers: Yu, U.S. Pat. No. 5,660,961; Yu, U.S. Pat. No. 5,215,839; and Katayama et al., U.S. Pat. No. 5,958,638. The term "photoreceptor" or "photoconductor" is generally used interchangeably with the terms "imaging member." The term "electrophotographic" includes "electrophotographic" and "xerographic." The terms "charge transport molecule" are generally used interchangeably with the terms "hole transport molecule."

To further increase the service life of the photoreceptor, use of overcoat layers has also been implemented to protect photoreceptors and improve performance, such as wear resistance. However, these low wear overcoats are associated with poor image quality due to A-zone deletion (i.e. an image defect occurred in A-zone: 28° C., 85% RH) in a humid environment as the wear rates decrease to a certain level. For example, most organic photoconductor (OPC) materials sets require a certain level of wear rate in order to suppress A-zone deletion, thus limiting the life of a photoreceptor. In addition, high torque associated with low wear overcoats in A-zone also causes severe issues, such as motor failure and cleaning blade damage.

However, even such conventional photoreceptors are not necessarily sufficient in electrophotographic characteristics and durability, particularly when they are used in combination with a charger of the contact-charging system (contact charger) or a cleaning apparatus, such as a cleaning blade. Further, when a photoreceptor is used in combination with a contact charger and a toner obtained by chemical polymerization (polymerization toner), image quality may be deteriorated due to a surface of the photoreceptor being stained with a discharge product produced in contact charging or the polymerization toner remaining after a transfer step. Still further, the use of a cleaning blade to remove discharge product or remaining toner from the surface of the photoreceptor involves friction and abrasion between the surface of the photoreceptor and the cleaning blade, which tends to damage the surface of the photoreceptor, breaks the cleaning blade or turns up the cleaning blade. As a result of this repetitive cycling, the outermost layer of the photoreceptor experiences a high degree of frictional contact with other machine subsystem components used to clean and/or prepare the photoreceptor for imaging during each cycle. When repeatedly subjected to cyclic mechanical interactions against the machine subsystem components, photoreceptor belts can experience severe frictional wear at the outermost organic photoreceptor layer surface that can greatly reduce the useful life of the photoreceptor. Ultimately, the resulting wear impairs photoreceptor performance and thus image quality.

Below are a number of prior art patents and/or publications that discuss the above concepts.

U.S. Patent Publication No. 20090169237 to Shouno et al. discloses a cleaning roller for cleaning a charging roller in an image forming apparatus. The cleaning roller is in contact with an outer peripheral surface of the charging roller to remove foreign materials attached to the outer peripheral surface.

U.S. Pat. No. 6,381,432 to Hattori discloses a power supply roller, which rotates while contacting the surface of the charging roller, and applies a bias to the charging roller for charging a surface of the photoconductive drum uniformly. Brushes may be provided on the surface of the power supply roller. A member may also be supplied for removing toner and sheet particles adhering to the surface of the charging roller and the power supply roller.

U.S. Patent Publication No. 2004019986 discloses a contact cleaning roller which may be axially flexed to conform to a non-planar substrate for removing particles therefrom. A flexible shaft is covered with a high-tack sleeve comprising polyurethane, silicone, adhesive tape, or any other similar high-tack material. The shaft is rotatably suspended at either end in bearings in a frame, allowing the roller to conform to a non-planar substrate surface requiring cleaning.

U.S. Pat. No. 7,515,846 to Miyagi disclose a cleaning device that cleans a charging roller, which charges the outer circumferential surface of a photoconductive drum. The cleaning device has a rotary shaft that rotates in contact with the outer circumferential surface of the charging roller and cleans the outer circumferential surface of the charging roller by brushing. The rotational driving unit rotates the cleaning member. A thrust driving unit reciprocates the cleaning member along the rotary axis of the charging roller while holding the cleaning member in sliding contact with the outer circumferential surface of the charging roller.

U.S. Pat. No. 8,064,791 to Imaizumi discloses a charging device which has a rotatable charging member that electrically charges a photosensitive member. A brush, which rotates along a rotational direction of the charging member by contacting the charging member to receive a force, includes fiber for cleaning the charging member. The fibers have been subjected to a fiber-tilting treatment so that the fibers are tilted in a direction counterdirectionally with a rotation direction of the brush.

U.S. Pat. No. 8,180,256 to Komatsu discloses an image forming apparatus including a photosensitive member, a developing device, a transferring device, a first brush and a second brush. The first brush is downstream of the transfer position and upstream of the photosensitive member charging position. The second brush is downstream of the toner charging position and upstream of the photosensitive member charging position. The first brush is supplied with a charging bias having a polarity opposite to a regular charge polarity of the toner. The second brush is supplied with a charging bias having a same polarity as the regular charge polarity.

U.S. Pat. No. 4,435,074, U.S. Pat. No. 7,881,651, US 20100189461, and US 201102064 describe a method to use lubricant application brush to apply fine solid powder to photoreceptor (P/R) surface to lubricate cleaning blade. US 20100189461, US 20110123239, U.S. Pat. No. 7,725,069 describe strategies to extend lifetime of brush applicator.

An improved electrophotographic imaging member has been developed that comprises a very thin outer layer on the imaging member surface that comprises functional materials that act as a lubricant and or a barrier against moisture and/or surface contaminants. The outer layer imparts improved xerographic performance to imaging members incorporating such an outer layer, such as improved wear resistance, low friction, and reduced image defects due to deletion in high humidity conditions. A surface control method has been developed that involves the continuous delivery of a liquid functional material, such as paraffin oil, to the surface of an electrophotographic imaging member through an oil-impregnated delivery roll in direct contact with the BCR (Ser. No. 13/192,215). An improved electrophotographic imaging member comprises a very thin outer layer on the imaging member surface that includes functional materials that act as a lubricant and or a barrier against moisture and/or surface contaminants. The outer layer imparts improved xerographic performance to imaging members incorporating such an outer layer, such as improved wear resistance, low friction, and reduced image defects due to deletion in high humidity conditions.

Illustratively, US Patent Publication No. 20120201585, and U.S. patent application Ser. Nos. 13/192,215, 13/192,252, and 13/279,981, 13/286,905, 13/326,414 describe this improved method of applying, via a delivery roller, an ultra-thin layer of functional materials such as paraffin oil through self-diffusion on ultra-low P/R surface to suppress A-zone deletion and high-torque.

In these embodiments, the delivery roll delivers the functional materials to the outer layer of an imaging surface. As used herein, "functional material" is a material that provides maintenance of desired photoreceptor function. For example, the functional material may be one that is continuously applied onto the photoreceptor surface through direct contact transfer and which can maintain the desired function(s) of the photoreceptor by providing continued lubrication and surface protection. Lubrication of the photoreceptor surface improves interaction with other components in a xerographic system, such as for example, the blade cleaner to reduce torque and blade damage. By maintaining a thin layer of surface material on the photoreceptor, the functional material also provides surface protection to prevent image deletion in, for example, a humid environment such as A-zone.

The paraffin oil as applied over the photoreceptor surface alleviates the chattering of blade and reduces toner contamination on the BCR. However, in practice relying only on this improvement in the delivery roll does not completely address the contamination issue, i.e., there is additive accumulation on BCR during longer-time cycling. Furthermore, additives also start to build up on the delivery roll surface to block effective diffusion of oil from the roll body, which shortens the lifetime of the delivery roll.

When the functional material is applied, it is important that a uniform film of the functional material (e.g., the paraffin oil) is delivered. If a uniform film is not applied to the photoreceptor (or the bias charge roller) and some areas of the photoreceptor or bias charge roller have less oil applied (due to the non-uniform delivery), problems may occur. These problems include, but are not limited to, i) local damage to the cleaning blade, which leads to contamination of the system (for example, the bias charge roller), and ultimately, to non-inform image density (or poor image quality) and ii) A-zone deletion; and iii) higher torque in the system. The higher torque may lead to cleaning blade damage due to the friction between the photoreceptor and the cleaning blade.

This problem may be minimized or eliminated by maintaining good contact between the delivery roller and the photoreceptor (or BCR) to ensure uniform delivery of the functional material, such as paraffin oil.

Accordingly, a need exists for a new design or method that optimizes the contact of the delivery roller with the photoreceptor (or bias-charge roller) or places the delivery roller in uniform contact with the photoreceptor (or bias-charge roller)

and extends the lifetimes of the BCR, the photoreceptor, the cleaning mechanism and the delivery roller.

SUMMARY OF THE INVENTION

In embodiments of the invention, an image forming apparatus includes an electrophotographic photoconductive member and a delivery unit. The delivery unit is disposed in contact with a surface of the photoconductive member to apply a layer of functional materials to the surface of the photoconductive member, wherein a cylindrical axis of the delivery unit is angled with respect to a cylindrical axis of the photoconductive member to increase uniformity of the functional materials layer. The angling of the cylindrical axis of the delivery unit with respect to the cylindrical axis of the photoconductive member ranges from 0.1 to 15 degrees.

In embodiments of the invention, an image forming apparatus includes an electrophotographic photoconductive member, a charging unit and a delivery unit. The charging unit is disposed in contact with the surface of the charging unit, wherein the delivery unit applies a layer of functional materials to the surface of the photoconductive member, and a cylindrical axis of the delivery unit is angled with respect to a cylindrical axis of the charging unit to increase the uniformity of the functional materials layer. The angling of the cylindrical axis of the delivery unit with respect to the cylindrical axis of the photoconductive member ranges from 0.1 to 15 degrees.

In embodiments of the invention, an image forming apparatus includes an electrophotographic photoconductive member, a delivery unit, an electrostatic latent image forming unit, a toner developing unit, and a transfer unit The delivery unit is disposed in contact with a surface of the photoconductive member to apply a layer of functional materials to the surface of the photoconductive member and a cylindrical axis of the delivery unit is angled with respect to a cylindrical axis of the photoconductive member to increase the uniformity of the functional materials layer. The electrostatic latent image forming unit develops an electrostatic latent image of the photoconductive member. A toner developing unit for applying toner to the photoconductive member to develop a toner image on the photoconductive member. A transfer unit for transferring the developed toner image from the photoconductive member to a copy substrate or an intermediate member.

BRIEF DESCRIPTION OF THE DRAWINGS

FIG. 3(*b*) illustrates a front view of an alignment of a delivery roller with respect to a photoreceptor or bias charge roller according to an embodiment of the invention;

FIG. 3(*c*) illustrates a front view of an alignment of a delivery roller with respect to a photoreceptor or bias charge roller where a cylindrical axis of the outer layer of the delivery roller is angled with respect to a cylindrical axis of a core shaft of the delivery roller according to an embodiment of the present invention;

FIG. 5(*b*) illustrates torque measurement versus angled alignment in a second test environment according to an embodiment of the invention.

DETAILED DESCRIPTION OF THE INVENTION

The presently disclosed embodiments are, therefore, to be considered in all respects as illustrative and not restrictive, the scope of embodiments being indicated by the appended claims rather than the foregoing description. All changes that come within the meaning of and range of equivalency of the claims are intended to be embraced therein.

The disclosed embodiments are directed to a system and method of aligning a delivery unit with respect to a electrophotographic photoconductive member or a charging unit. In an embodiment of the invention, the delivery unit may be a delivery roller, the electrophotographic photoconductive member may be a photoreceptor and the charging unit may be a bias charge roller (BCR).

The delivery roller is in contact with a photoreceptor or a BCR and is continuously rotated. The delivery roller applies a thin layer of functional material coating onto the photoreceptor or BCR. The system works optimally if the delivery roller maintain a close contact with the photoreceptor or BCR, which helps to ensure uniform distribution or application of the functional material onto the photoreceptor or BCR. The delivery roller includes a core shaft and at least one outer layer. In order to maintain the close contact of the delivery roller and the photoreceptor, the cylindrical axis of the outer layer is aligned at an angle with the cylindrical axis of the photoreceptor (or BCR). By positioning the cylindrical axis of the outer layer of the delivery roller with the cylindrical axis of the P/R or BCR, torque is minimized between the cleaning blade and the photoreceptor.

Figure 1A:
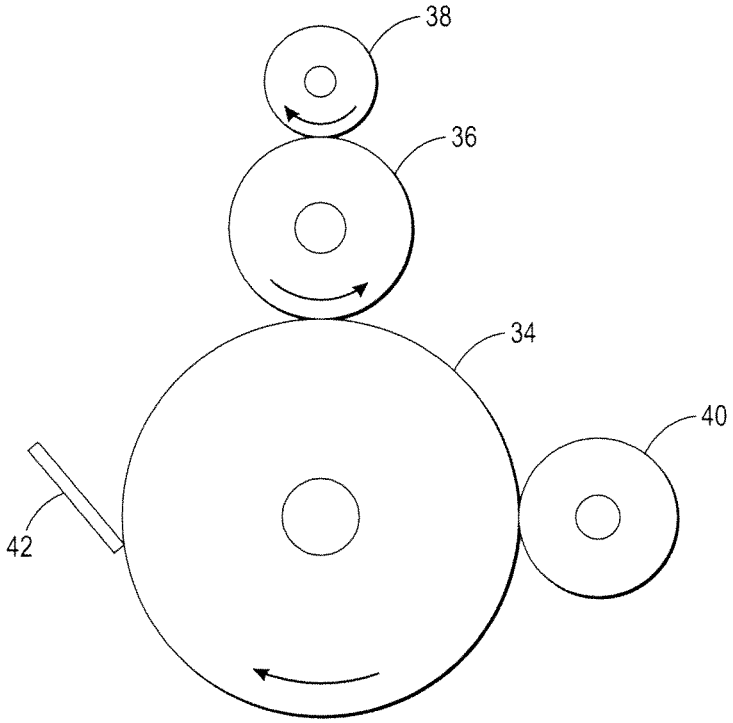
FIG. 1A PRIOR ART
FIG. 1A illustrates an image forming apparatus according to the prior art.

FIG. 1A illustrates an image forming apparatus according to the prior art system described in U.S. patent application Ser. No. 13/192,215. The image-forming apparatus includes a photoreceptor 34, a BCR 36 and a delivery member 38. The delivery member 38 contacts the BCR 36 to deliver an ultra-thin layer of the functional material onto the surface of the BCR 36. The BCR 36, in turn, transfers the functional material onto the surface of the photoreceptor 34. The delivery member may be integrated into a xerographic printing system in various configurations and positions. As can be seen, the overcoated photoreceptor drum 34 rotates, the delivery member 38 impregnated with the functional material delivers the functional materials to the surface of the BCR roller 36, which in turn, delivers the functional materials to the surface of the overcoated photoreceptor 34 through contact diffusion. For example, the amount of the functional material delivered onto the surface of the imaging member is controlled by the diffusion rate of the functional material in the elastic material of the delivery member.

Subsequently, the photoreceptor 34 is substantially uniformly charged by the BCR 36 to initiate the electrophotographic reproduction process. The charged photoreceptor 34 is then exposed to a light image to create an electrostatic latent image on the photoreceptive member (not shown). The latent image is subsequently developed into a visible image by a toner developer 40. Thereafter, the developed toner image is transferred from the photoreceptive member to a copy sheet or some other image support substrate to which the image can be permanently affixed for producing a reproduction of the original document (not shown). The photoreceptor surface is generally then cleaned with a cleaner 42 to remove any residual developing material thereform, in preparation for successive imaging cycles. While not necessary, a supplying unit containing the functional materials may be included for supply of the functional material to the delivery member. In embodiments which do not have the supplying unit, the supplying unit may be selected from the group consisting of a reservoir, polymeric matrix, porous foam, membrane and fabrics.

Figure 1B:
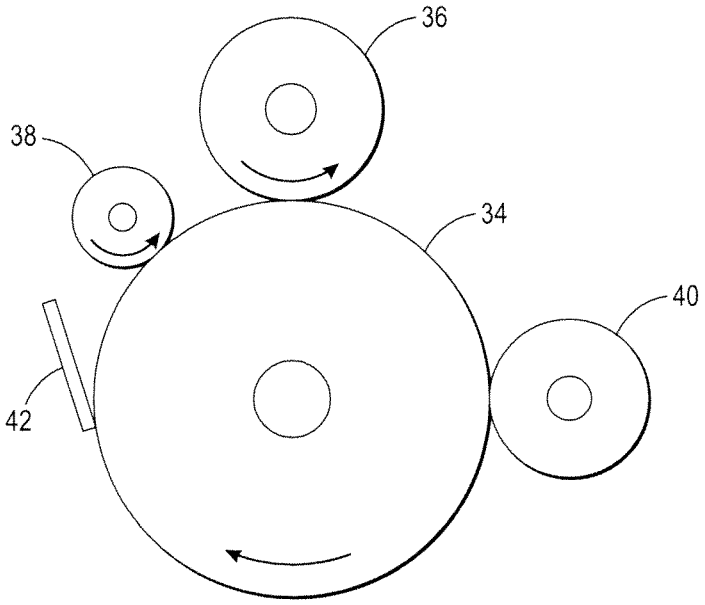
FIG. 1B PRIOR ART
FIG. 1B illustrates an image forming apparatus according to the prior art system.

FIG. 1B illustrates an image forming apparatus according to the prior art. There is illustrated an image-forming apparatus in a BCR charging system. As shown, the image-forming apparatus comprises a photoreceptor 34, a BCR 36 and a delivery member 38. The delivery member 38 contacts the photoreceptor 34 to deliver an ultra-thin layer of a functional material onto the surface of the photoreceptor 34. Subsequently, the photoreceptor 34 is substantially uniformly charged by the BCR 36 to initiate the electrophotographic reproduction process. The charged photoreceptor is then exposed to a light image to create an electrostatic latent image on the photoreceptive member (not shown). This latent image is subsequently developed into a visible image by a toner developer 40. Thereafter, the developed toner image is transferred from the photoreceptor member through a record medium to a copy sheet or some other image support substrate to which the image may be permanently affixed for producing a reproduction of the original document (not shown). The photoreceptor surface is generally then cleaned with a cleaner 42 to remove any residual developing material therefrom, in preparation for successive imaging cycles. Either of these embodiments may be utilized in the present invention along with other configurations of the image forming apparatus.

Figure 2:
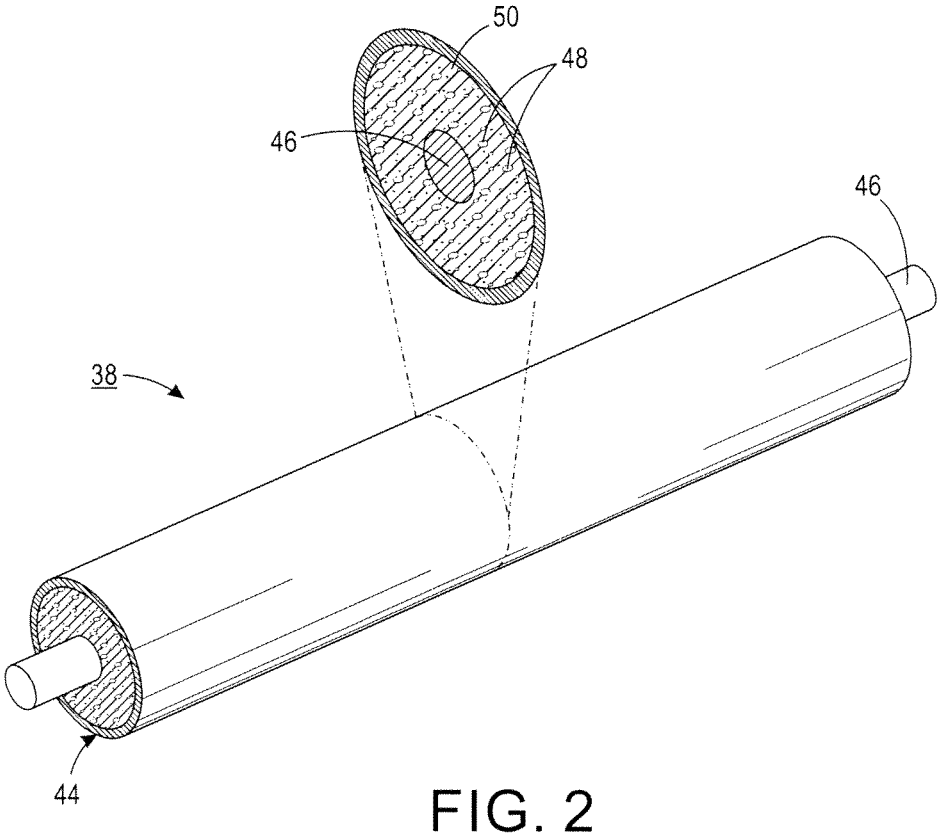
FIG. 2 illustrates a cross-section of a delivery member or unit according to the prior art.

FIG. 2 illustrates a cross-section of a delivery member or unit 38 according to the prior art. The delivery member 38 comprises an elastomeric matrix 44 disposed around a support member 46. In embodiments, the support member 46 is a stainless steel rod. The support member can further comprises a material selected from the group consisting of a metal, plastics, ceramic, and mixtures thereof. The diameter of the support member and the thickness of the elastomeric matrix can be varied depending on the application needs. In specific embodiments, the support member has a diameter of, for example, from about 3 mm to about 10 mm. In specific embodiments, the elastomeric matrix has a thickness of, for example, from 20 um to about 20 mm. In embodiments, the elastomeric matrix 44 may comprises hydrophobic functional materials 48 retained within a polymer matrix 50 such as a cross-linked silicone which forms a matrix that facilitates retainment of the functional materials.

In some embodiments, the functional material is integrated into the composition of the delivery member 38 and thus eliminates the need for a separate supply of materials within the system or the need to constantly reapply the materials to the delivery member. Thus, the delivery member 38 serves the dual purpose of a reservoir and distributor of the functional material. In addition, the delivery members fabricated according to the present embodiments have shown to contain sufficient quantities of the functional material to continuously supply an ultra thin layer of the functional material to the surface of the BCR 36/photoreceptor 34.

Figure 3A:
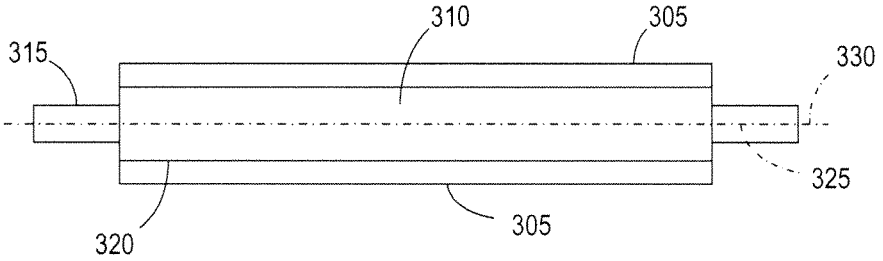
FIG. 3(*a*) illustrates a front view of an alignment of a delivery roller with respect to a photoreceptor or bias charge roller according to the prior art.
Figure 3B:
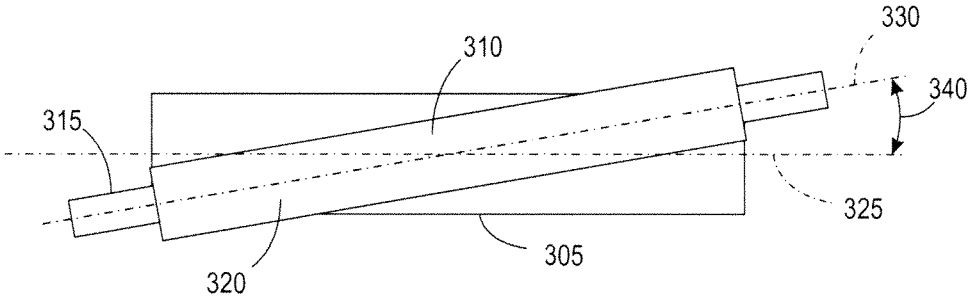
Figure 3C:
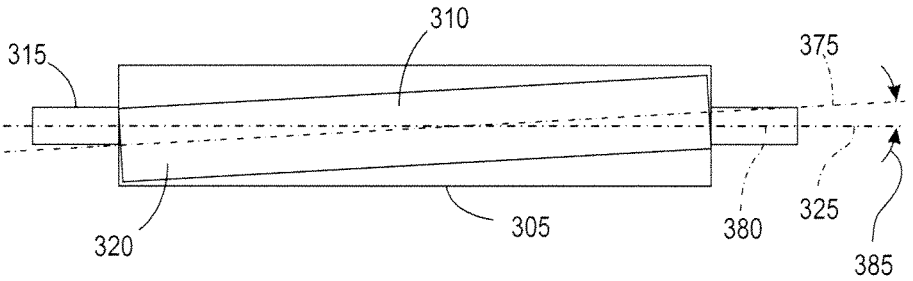

FIG. 3(*a*) illustrates a front view of an alignment of a delivery roller with respect to a photoreceptor or bias charge roller according to the prior art. Embodiments of the invention include a photoconductor as an electrophotographic photoconductive member, a delivery roller as the delivery unit, and a BCR as a charging unit.

In the embodiment illustrated in FIG. 3(*a*); a cylindrical axis of the core shaft 315 of the delivery roller 310 is in alignment with a cylindrical axis of the outer layer 320 of the delivery roller 310 as well as with the cylindrical axis 325 of the photoreceptor or bias charge roller. In other words, the cylindrical axis for each of the core shaft, outer layer and photoreceptor are parallel with each other. Because the cylindrical axis of the core shaft 315 of the delivery roller 310 is in alignment with the cylindrical axis of the outer layer 320, the cylindrical axis 330 of the outer layer 320 of the delivery roller is also in alignment with the cylindrical axis of the photoreceptor and or bias charge roller.

FIG. 3(*b*) illustrates a front view of an alignment of a delivery roller with respect to a photoreceptor or bias charge roller according to an embodiment of the invention. In this embodiment of the invention, a cylindrical axis of the delivery unit is angled with respect to a cylindrical axis of the photoconductive member to increase uniformity of the functional materials layer.

In the embodiment of the invention illustrated in FIG. 3(*b*), the core shaft 315 and the outer layer 320 (and therefore the cylindrical axis 330) of the delivery roller 310 is angled or offset with respect to the photoreceptor (or bias charge roller) 305 (and the cylindrical axis of the photoreceptor or BCR). Therefore, the core shaft 315 and the outer layer 320 (and therefore the cylindrical axis 330) of the delivery roller 310 are angled with respect to the cylindrical axis 325 of the photoreceptor or BCR 305. The angle is identified as reference number 340 in FIG. 4(*b*). In embodiments of the invention, the angle may range from 0.1 degrees up to 15 degrees. As discussed, the delivery roller 310 includes a core shaft 315 and at least one outer layer 320. The design of angling the delivery roller 310 with respect to the photoreceptor (or BCR) improves the performance of the system to allow better contact of the delivery roller 310 with the photoreceptor 305 or BCR and to increase uniformity of the functional materials layer. The effectiveness of the delivery roller (the functional material application system) to suppress image defects and extend the lifetime of the cleaning blade and BCR depends on both a critical thickness and the uniformity of the functional material layer provided by the delivery roller. Non-conformal contact of the delivery roller and the photoreceptor or BCR may cause unevenness of the functional material (e.g., a film).

If a ratio of the roller length to the roller thickness becomes large, the tolerance of straightness of the delivery roller becomes more significant. The straightness is referring to the whether or not the roller is bowed or straight. Since the delivery roller is fabricated utilizing an elastomeric material, the non-uniformity of the roller can potentially be overcome by applying more pressure to the delivery roller to make better contact with the photoreceptor or the bias charge roller. However, applying more pressure to the delivery roller may result in undesirable side effects. More specifically, applying pressure to the delivery roller may result in damage to the surface of the photoreceptor and the bias charge roller which would decrease performance and shorten its working lifetime or more oil to be applied to some areas of the photoreceptor or bias charge roller.

Aligning the cylindrical axis of the delivery roller offset or angled from the cylindrical axis of the photoreceptor or BCR results in improvement in conformal contact between the delivery roller and the photoreceptor or BCR. The offset or angled alignment did not damage the surface of the photoreceptor or BCR and results in uniform application of the functional material (e.g., oil) on the delivery roller. This minimizes torque in the system that is generated due to friction between the cleaning blade and the photoreceptor. In embodiments of the invention where different types of photoreceptors or bias charge rollers are used, or where the delivery roller is made of a different material, the torque between the cleaning unit and the photoreceptor may need to be monitored in order to determine the optimal angle at which to align or offset the delivery roller with respect to the photoreceptor or the BCR.

FIG. 3(*c*) illustrates a front view of an alignment of a delivery roller with respect to a photoreceptor or bias charge roller where a cylindrical axis of the outer layer of the delivery roller is angled with respect to a cylindrical axis of a core shaft of the delivery roller according to an embodiment of the present invention. In the embodiment of the invention illustrated in FIG. 3(*c*), the delivery roller may be non-concentric. The cylindrical axis 375 of the outer layer 320 of the delivery roller 310 is angled with respect to the cylindrical axis 380 of the core shaft 315 of the delivery roller 310. The angle is represented in FIG. 3(*c*) by reference number 385. The angling of the axis 375 of the outer layer 320 of the delivery roller 310 with the axis 380 of the core shaft may be completed during the molding process of the delivery roller. In this embodiment of the invention, the original design of the customer replaceable unit may not need to be changed since the angling occurs within the delivery roller 410 itself. Both of the methods and embodiments described in FIGS. 3(*b*) and (*c*) reduce torque and deliver functional material more uniformly, which will result in good image quality.

Figure 4:
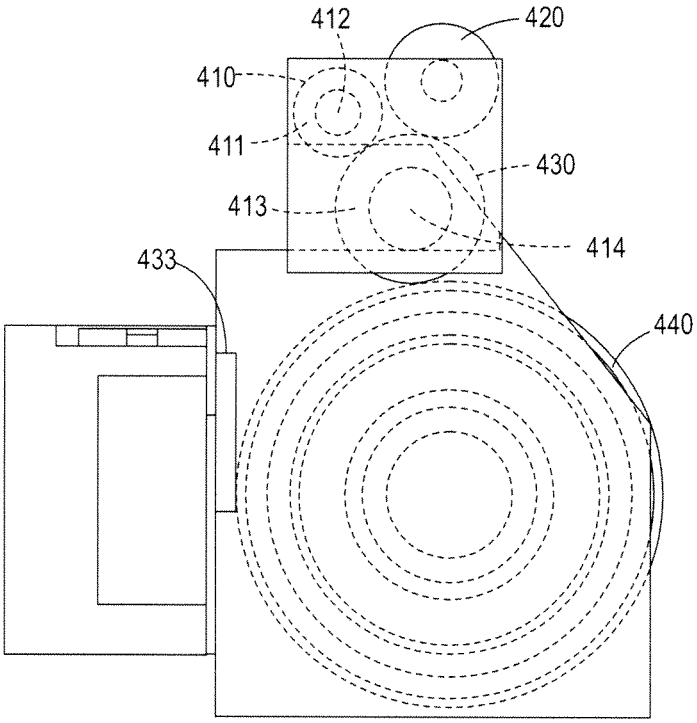
FIG. 4 illustrates a cross-sectional view of a dual roll system implementing an angled delivery roller according to an embodiment of the invention.

FIG. 4 illustrates a cross-sectional view of a dual roll system implementing an angled delivery roller according to an embodiment of the invention. The alignment of the delivery roller illustrated in FIGS. 3(*b*) and 3(*c*) is equally applicable to a system such as the one illustrated in FIG. 4 which includes a delivery roller and a cleaning foam roller. Further, the alignment of the delivery roller illustrated in FIGS. 3(*b*) and 3(*c*) is equally applicable to the dual roller system including a delivery roller and cleaning foam roller described in patent application Ser. No. 13/773,430, filed Feb. 21, 2013, entitled Dual Roll System Integrating A Delivery Roll And A Cleaning Roll To Extend The Lifetime Of The BCR System.

FIG. 4 illustrates an embodiment of the invention where the cylindrical axis of the delivery unit is offset or angled with respect to the cylindrical axis of the charging unit. The printing apparatus illustrated in FIG. 4 includes a delivery unit 410, a first cleaning unit 420, a charging unit 430, a second cleaning unit 433, and a photoreceptor 440, and a developer housing 495. The customer replaceable unit in this dual roll system embodiment includes the second cleaning unit 433, the photoreceptor 440 and the charging unit 430.

In embodiments of the invention, the first cleaning unit may be a cleaning foam roller, the delivery unit may be a delivery roller, the second cleaning unit may be a cleaning blade and the charging unit may be a bias charge roller (BCR). While this description refers to particular embodiments, it will be understood that many modifications may be made without departing from the spirit thereof.

The delivery unit 410 contacts the charging unit 430 to deliver an ultra-thin layer of the functional material onto the surface of the charging unit 430. The charging unit 430, in turn, transfers the functional material onto the surface of the photoreceptor 440. The delivery unit 410 may include an outer layer 411 and a core shaft 412. The charging unit 430 may have an outer layer 413 and a core shaft 414. In order to improve contact between the outer layer 411 of the delivery unit 410 and the outer layer 413 of the charging unit 430, a cylindrical axis of the delivery unit 410 may be offset with respect to the cylindrical axis of the charging unit 430. This may increase contact between the outer surfaces of the delivery unit 410 and charging unit 430 respectively, which results in more uniform application of the functional material onto the charging unit 430. Further, it also results in torque being minimized due to less friction between the cleaning unit 433 and the photoreceptor 440. The overcoated photoreceptor drum 440 rotates, the delivery unit 410 impregnated with the functional material delivers the functional materials to the surface of the charging unit 430, which in turn, delivers the functional materials to the surface of the overcoated photoreceptor 440 through contact diffusion. For example, the amount of the functional material delivered onto the surface of the imaging member is controlled by the diffusion rate of the functional material in the elastic material of the delivery unit.

Subsequently, the photoreceptor 440 is substantially uniformly charged by the charging unit 430 to initiate the electrophotographic reproduction process. A first clearing unit 420 removes contamination particles from the charging unit 430 before the contamination particles are transferred back to the delivery unit 410. The first cleaning unit 420 also reduces toner/additive contamination from entering the delivery unit transport area, (e.g., if the delivery unit is a delivery roller, then preventing contamination from entering the roll zone) and extends the lifetime of the delivery unit 410. The cleaning unit 420 may also absorb excess functional material (e.g., paraffin oil). The cleaning unit 430 may also eliminate a contact line that appears on the delivery unit 410 after the delivery unit sits for a long period of time in static contact with the charging unit 420. The charged photoreceptor 440 is then exposed to a light image to create an electrostatic latent image on the photoreceptive member. The latent image is subsequently developed into a visible image by a toner developer. Thereafter, the developed toner image is transferred from the photoreceptive member to a copy sheet or some other image support substrate to which the image can be permanently affixed for producing a reproduction of the original document (not shown). The photoreceptor surface is generally then cleaned with a separate or second cleaning unit 433 to remove any residual developing material thereform, in preparation for successive imaging cycles. While not necessary, a supplying unit containing the functional materials may be included for supply of the functional material to the delivery member.

In embodiments which do not have the supplying unit, the supplying unit may be selected from the group consisting of a reservoir, polymeric matrix, porous foam, membrane and fabrics. Subsequently, the photoreceptor 440 is substantially uniformly charged by the charging unit 430 to initiate the electrophotographic reproduction process. The charted photoreceptor is then exposed to a light image to create an electrostatic latent image on the photoreceptive member (not shown). The latent image is subsequently developed into a visible image by a toner developer (not shown). Thereafter, the developed toner image is transferred from the photoreceptive member to a copy sheet or some other image support substrate to which the image can be permanently affixed for producing a reproduction of the original document (not shown). The photoreceptor surface is generally then cleaned with a cleaner to remove any residual developing material thereform, in preparation for successive imaging cycles. While not necessary, a supplying unit containing the functional materials may be included for supply of the functional material to the delivery member. In embodiments which do not have the supplying unit, the supplying unit may be selected from the group consisting of a reservoir, polymeric matrix, porous foam, membrane and fabrics.

Reduction to Practice

The invention was reduced to practice. Tests were performed using a 41 Polydimehylsiloxane (PDMS) paraffin oil delivery roller, and over-coated photoreceptor and the DC250 toner package. An overcoated drum used in a DC250 toner package had shown high cleaning blade friction and image deletion defects when the bias-charge roller was charged in an environment being at 28° C. and 80% relative humidity (RH). This is referred to as the A-zone. The combination of the photoreceptor and toner was run in the A-zone environment, utilizing a paperless test xerographic fixture that is based on the Xerox DC 250 print engine. The paperless test xerographic fixture provides for full xerographic function except for toner transfer from the photoreceptor to the transfer belt and toner transfer from the transfer belt to the paper. The paperless test xerographic fixture has a geometry that allows for a jig to place the paraffin oil delivery roller (DR) in different angled contacts with the photoreceptor or the bias-charge roller.

In this test embodiment, the paperless test xerographic fixture only had contact with the photoreceptor. The bias charge roller was tested in two different test settings: The first test setting had a DC voltage of −500 Volts and an AC voltage of 1.64 kiloVolts. The second test setting had a DC voltage of −600 Volts and an AC voltage of 1.64 kiloVolts.

Figure 5A:
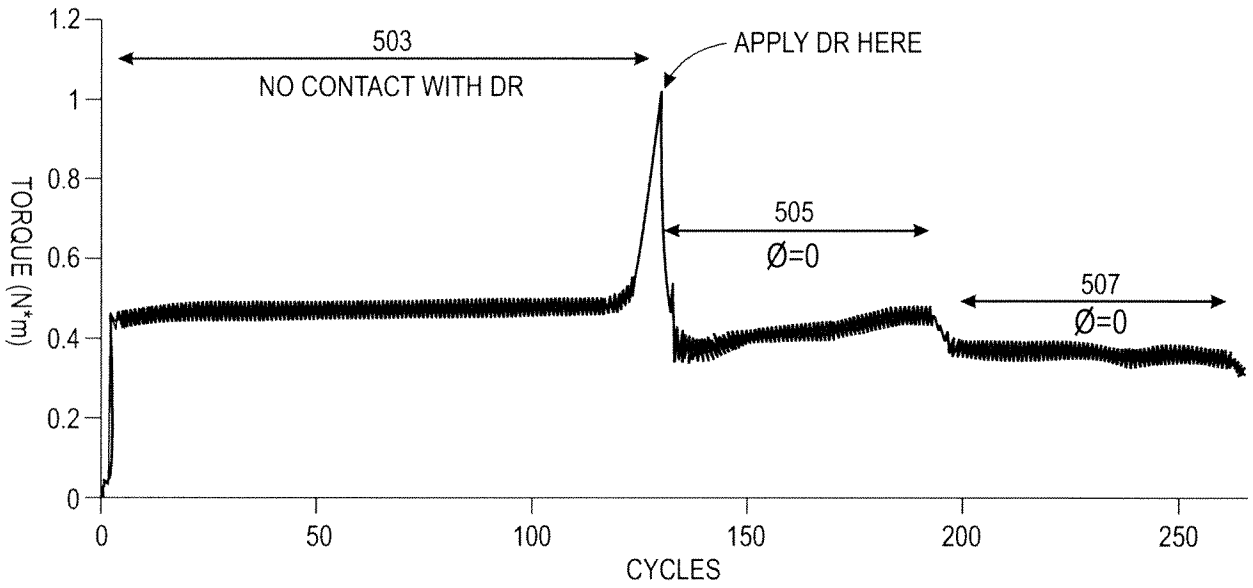
FIG. 5(*a*) illustrates torque measurement versus angled alignment in a first test environment according to an embodiment of the invention.
Figure 5B:
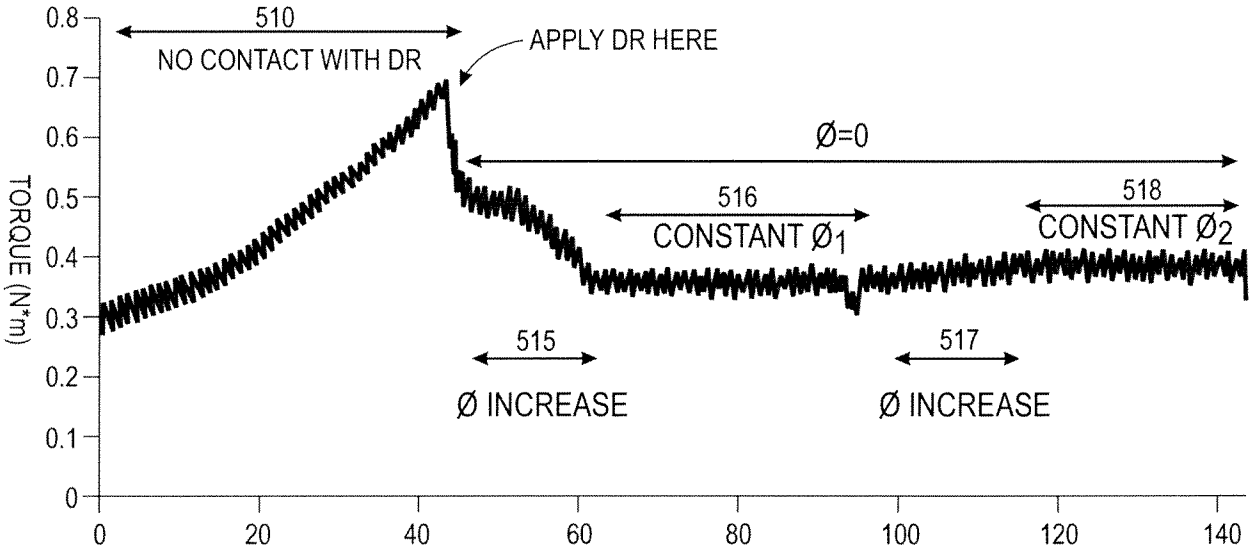

FIG. 5(*a*) illustrates torque measurement versus angled alignment in a first test environment according to an embodiment of the invention. In both test settings, if the delivery roller is not in contact with the photoreceptor, the torque jumps from a baseline point of approximately 0.35 Newton/meter to a much higher torque (e.g., 1.1 Newtons/meter in FIG. 5(*a*) or 0.70 Newtons/meter in FIG. 5(*b*)). If the torque experienced by the test fixture is this high (i.e., greater than 0.7 Newtons/meter), then there is danger of cleaning blade damage. 0.7 Newtons/meter is a critical point to indicate that damage to the cleaning blade is imminent.

In the first setting, when the delivery roller was not in contact with the photoreceptor, the torque increased from approximately 0.35 or 0.4 to approximately 1 or 1.1 Newtons/meter. This increase in torque is illustrated by reference number 502. The application of the delivery roller in parallel contact with the photoreceptor reduces the torque to an average 0.5 Newtons per meter. This is illustrated in FIG. 5(*a*) by reference number 505. The torque initially decreased to approximately 0.35 Newtons per meter; however, as the number of cycles increases, the torque began to increase and moved towards 0.5 Newtons/meter (as shown by reference number 605). When the cylindrical axis of the delivery roller and the cylindrical axis of the photoreceptor were angled or offset, as is illustrated in FIGS. 3(*b*) and (*c*), the torque began to decrease and decreased to approximately 0.35 Newtons/meter. This is illustrated by reference number 507 which illustrates a decrease in torque during the timeframe that the cylindrical axis of the delivery roller and the cylindrical axis of the photoreceptor was angled or offset (as compared to the increasing torque illustrated by reference number 505).

FIG. 5(*b*) illustrates torque reduction versus angled alignment of the delivery roller and the photoreceptor in a second test environment according to an embodiment of the invention. The second test environment applies a −600 volts DC to the bias charge roller with an AC voltage of 1.64 kilovolts. In a first time period, when there is no contact between the delivery roller and the photoreceptor, as shown by reference number 513, the torque increases from 0.3 to 0.7 Newtons/meter. When the delivery roller is placed in contact with the photoreceptor at an angle during a second time period, the torque immediately starts to decrease. As the angle of offset between the cylindrical axis of the delivery roller and the cylindrical axis of the photoreceptor is increased as is illustrated in reference number 515, the torque continues to decrease and reaches about 0.4 to 0.35 Newtons/meter. In a third time period, as illustrated by reference number 516, the angle between the delivery roller and the photoreceptor is kept constant (at the same position it was at the end of the second time period), and the torque is maintained at the low 0.4 to 0.35 Newtons per meter. Then, in a fourth time period, the angle of offset between the cylindrical axis of the delivery roller and the cylindrical axis of the photoreceptor is increased. For reference, the angle at the end of the second time period (and during the whole third time period is x degrees). When the angle of offset is increased higher than x, this results in a slowly increasing torque. This illustrates that there is a maximum angle that can be reached and if the angle of the offset is greater than this maximum angle, the torque increases and the benefit of the angled offset between the delivery roller and photoreceptor (i.e., the reduced friction and reduced torque) is being minimized. For reference, at the end of the fourth time period, the angle of offset is (x+y) degrees. In a fifth time period, the offset angle is kept constant at the angle of (x+y) degrees and the torque is maintained at the higher level that was present during the fourth time period.

At will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

While the description above refers to particular embodiments, it will be understood that many modifications may be made without departing from the spirit thereof. The accompanying claims are intended to cover such modifications as would fall within the true scope and spirit of embodiments herein.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

All the patents and applications referred to herein are hereby specifically, and totally incorporated herein by reference in their entirety in the instant specification.

What is claimed is:

1. An image forming apparatus comprising:

a) an electrophotographic photoconductive member; and b) a delivery unit disposed in contact with a surface of the photoconductive member to apply a layer of functional materials to the surface of the photoconductive member, wherein a cylindrical axis of the delivery unit is angled with respect to a cylindrical axis of the photoconductive member to increase the uniformity of the functional materials layer; further wherein the angling of the cylindrical axis of the delivery unit with respect to the cylindrical axis of the photoconductive member ranges from 0.1 to 15 degrees.

2. The image forming apparatus of claim 1, wherein the delivery unit includes a core shaft and an outer layer, and a cylindrical axis of the core shaft and a cylindrical axis of the outer layer are both angled with respect to a lengthwise axis of the photoreceptor.

3. The image forming apparatus of claim 1, wherein the delivery unit includes a core shaft and an outer layer, and a cylindrical axis of the core shaft is parallel with the cylindrical axis of the photoreceptor and a cylindrical axis of the outer layer of the delivery unit is angled with respect to the cylindrical axis of the photoreceptor and the cylindrical axis of the core shaft of the delivery unit.

4. The image forming apparatus of claim 1, wherein the deliver unit comprises an elastomeric matrix and a functional material dispersed therein.

5. The delivery unit of the claim 4, wherein the elastomeric matrix comprises a material selected from the group consisting of polysiloxane, polyurethane, polyester, polyfluorosilioxanes, polyolefin, fluoroelastomer, synthetic rubber, natural rubber, and mixtures thereof.

6. The delivery unit of claim 4, wherein the functional material comprises a paraffin oil.

7. An image forming apparatus comprising:

(a) an electrophotographic photoconductive member;

(b) a charging unit disposed in contact with the surface of the photoconductive member; and (c) a delivery unit disposed in contact with the surface of the charging unit, wherein the delivery unit applies a layer of functional materials to the surface of the photoconductive member, and wherein a cylindrical axis of the delivery unit is angled with respect to a cylindrical axis of the charging unit to increase the uniformity of the functional materials layer; further wherein the angling of the cylindrical axis of the delivery unit with respect to the cylindrical axis of the photoconductive member ranges from 0.1 to 15 degrees.

8. The image forming apparatus of claim 7, wherein the delivery unit includes a core shaft and an outer layer, and a cylindrical axis of the core shaft and a cylindrical axis of the outer layer are both angled with respect to a lengthwise axis of the charging unit.

9. The image forming apparatus of claim 7, wherein the delivery unit includes a core shaft and an outer layer, and a cylindrical axis of the core shaft is parallel with the cylindrical axis of the charging unit and a cylindrical axis of the outer layer of the delivery unit is angled with respect to the cylindrical axis of the charging unit and the cylindrical axis of the core shaft of the delivery unit.

10. The image forming apparatus of claim 7, wherein the deliver unit comprises an elastomeric matrix and a functional material dispersed therein.

11. The delivery unit of the claim 7, wherein the elastomeric matrix comprises a material selected from the group consisting of polysiloxane, polyurethane, polyester, polyfluorosilioxanes, polyolefin, fluoroelastomer, synthetic rubber, natural rubber, and mixtures thereof.

12. The delivery unit of claim 7, wherein the functional material comprises a paraffin oil.

13. An image forming apparatus comprising:

(a) an electrophotographic photoconductive member;

(b) a delivery unit disposed in contact with a surface of the photoconductive member to apply a layer of functional materials to the surface of the photoconductive member, wherein a cylindrical axis of the delivery unit is angled with respect to a cylindrical axis of the photoconductive member to increase the uniformity of the functional materials layer; further wherein the angling of the cylindrical axis of the delivery unit with respect to the cylindrical axis of the photoconductive member ranges from 0.1 to 15 degrees;

(c) an electrostatic latent image forming unit that develops an electrostatic latent image of the photoconductive member;

(d) a toner developing unit for applying toner to the photoconductive member to develop a toner image on the photoconductive member; and (e) a transfer unit for transferring the developed toner image from the photoconductive member to a copy substrate or an intermediate member.

14. The image forming apparatus of claim 13, wherein the delivery unit includes a core shaft and an outer layer, and a cylindrical axis of the core shaft and a cylindrical axis of the outer layer are both angled with respect to a lengthwise axis of the photoreceptor.

15. The image forming apparatus of claim 13, wherein the delivery unit includes a core shaft and an outer layer, and a cylindrical axis of the core shaft is parallel with the cylindrical axis of the photoreceptor and a cylindrical axis of the outer layer of the delivery unit is angled with respect to the cylindrical axis of the photoreceptor and the cylindrical axis of the core shaft of the delivery unit.

16. The image forming apparatus of claim 1, wherein the deliver unit comprises an elastomeric matrix and a functional material dispersed therein and wherein the elastomeric matrix comprises a material selected from the group consisting of polysiloxane, polyurethane, polyester, polyfluorosilioxanes, polyolefin, fluoroelastomer, synthetic rubber, natural rubber, and mixtures thereof.

17. The delivery unit of claim 4, wherein the functional material comprises a paraffin oil.

* * * * *